US008580188B2

(12) United States Patent
Taal et al.

(10) Patent No.: US 8,580,188 B2
(45) Date of Patent: Nov. 12, 2013

(54) METHOD FOR PRODUCING A PENETRATOR

(75) Inventors: Cornelis Taal, Hermannsburg (DE); Rene Oudelhoven, Vaals (NL); Michael Vagedes, Hermannsburg (DE); Uta Lenz, Suderburg (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 1142 days.

(21) Appl. No.: 12/083,671

(22) PCT Filed: Sep. 30, 2006

(86) PCT No.: PCT/EP2006/009509

§ 371 (c)(1),
(2), (4) Date: Apr. 16, 2008

(87) PCT Pub. No.: WO2007/045342

PCT Pub. Date: Apr. 26, 2007

(65) Prior Publication Data

US 2009/0169411 A1 Jul. 2, 2009

(30) Foreign Application Priority Data

Oct. 18, 2005 (DE) ..... 10 2005 049 748

(51) Int. Cl.
*B22F 3/02* (2006.01)
*B22F 3/12* (2006.01)

(52) U.S. Cl.
USPC ..... 419/68; 419/42

(58) Field of Classification Search
USPC ..... 75/248; 425/78, 79; 264/109–128; 148/423; 420/430
IPC ..... B22F 3/00,5/00, 7/00; F42B 6/00, F42B 12/00; C22C 27/04
See application file for complete search history.

(56) References Cited

U.S. PATENT DOCUMENTS 2,552,090 A * 5/1951 Eusner ..... 264/113
3,979,234 A 9/1976 Northcutt, Jr. et al.

(Continued)

FOREIGN PATENT DOCUMENTS

AT 383979 9/1987
DE 4016051 11/1991

(Continued)

*Primary Examiner* — Scott Kastler
*Assistant Examiner* — Vanessa Luk
(74) *Attorney, Agent, or Firm* — Lucas & Mercanti, LLP; Klaus P. Stoffel

(57) ABSTRACT

The invention relates to a method for producing a penetrator (10) from a tungsten heavy metal with a high fraction of tungsten and an outer sheath (7), which consists of a material that is more ductile in relation to the penetrator core (6). To produce a penetrator (10) of this type in a cost-effective manner, according to the invention a twin-hopper filling device, which corresponds to the dimensions of the penetrator core (6), is introduced concentrically into a compression mold (1) that corresponds to the outer dimensions of the penetrator (10). The inner pipe (3) is filled with a first tungsten powder blend with a high fraction of tungsten for producing the penetrator core (6), while the annular gap between the outer wall of the inner pipe and the inner wall of the compression mold (1) is filled with a second tungsten powder blend with a lower fraction of tungsten, (approximately between 85% and 91%), than the first powder blend. Once the inner pipe (3) has been removed from the compression mold (1), the powder blend is then compressed in the known manner to produce the penetrator (10), the compressed body is subsequently sintered and cold-formed and the penetrator slug is finally finished.

9 Claims, 2 Drawing Sheets

(56) References Cited

U.S. PATENT DOCUMENTS

| | | | | |
|---|---|---|---|---|
| 4,032,335 | A * | 6/1977 | Zapf et al. | 419/6 |
| 5,064,462 | A | 11/1991 | Mullendore et al. | |
| 5,462,576 | A | 10/1995 | Stuitje et al. | |
| 5,821,441 | A * | 10/1998 | Kawamura | 75/248 |
| 5,872,327 | A | 2/1999 | Taal et al. | |
| 6,374,743 | B1 | 4/2002 | Hug et al. | |
| 2002/0059882 | A1 | 5/2002 | Begg | |
| 2004/0216589 | A1 | 11/2004 | Amick | |

FOREIGN PATENT DOCUMENTS

| | | |
|---|---|---|
| DE | 4113177 | 10/1992 |
| DE | 4318827 | 12/1994 |
| DE | 3821474 | 8/1998 |
| GB | 2244119 | 11/1991 |
| GB | 2255936 | 11/1992 |

* cited by examiner

METHOD FOR PRODUCING A PENETRATOR

This is a U.S. National Stage of application No. PCT/EP2006/009509, filed on Sep. 30, 2006. Priority is claimed on that application and on the following application:

Country: Germany, Application No.: 10 2005 049 748.9 Filed: Oct. 18, 2005

BACKGROUND OF THE INVENTION

The invention relates to a method for producing a penetrator having a penetrator core composed of a tungsten heavy metal (THM) with a high fraction of tungsten and an exterior sheath composed of a material that is more ductile compared to the penetrator core.

Penetrators composed of a tungsten heavy metal alloy generally have a high fraction of tungsten (90 to approximately 97 wt.-%) because, due to their high mass, these materials have good penetration performance with vertical impact on simple armored targets. However, the high tungsten fraction causes brittleness in the material such that, in the case of oblique targets or multi-plate targets, the penetrator often breaks, even before penetrating the target. As a rule, due to their low mass, the kinetic energy of the relatively short broken pieces that result is not sufficient to penetrate the remaining target plate(s).

The brittleness of known THM penetrators frequently increases by virtue of the fact that, during mechanical processing, for example, during turning or grinding, cracks occur in the tungsten grains near the surface, which then may lead to an early failure of the penetrator in question due to the spreading of the cracks.

DE 41 13 177 C2 discloses removing the outer tungsten layers in the geometry of the finished penetrator by etching in order to increase the stability of mechanically processed penetrators. It has actually been shown that such an etching off of the exterior tungsten layers causes a considerable increase (i.e., up to 20%) in the impact value of the respective penetrator.

However, the known method has the disadvantage that acids must be used that are harmful to the application and to the environment. Moreover, the production of such penetrators is relatively labor intensive because the predetermined mass of the penetrator may not be influenced by the etching process.

Furthermore, DE 40 16 051 C2 discloses a penetrator in which a breakable penetrator core composed, for example, of tungsten heavy metal, is protected by a ductile shell. For this purpose, the ductile shell, composed, for example, of steel, is applied with a positive fit to the tungsten core by roller spinning. This known method is also relatively costly and time consuming.

SUMMARY OF THE INVENTION

The object of the invention is to provide a method for producing a penetrator with a brittle penetrator core and a ductile sheath that is simpler than comparable known methods.

The invention is essentially based on the idea of inserting a double funnel filling device adapted to the dimensions of the penetrator in a concentric fashion into a compression mold adapted to the outer dimensions of the penetrator. While the inner pipe is filled with a first powder mixture containing tungsten with a high fraction of tungsten (90 to 99 wt.-%) in order to produce the penetrator core, a second powder mixture containing tungsten with a lower fraction of tungsten (approximately between 83% and 91%) is placed in the annular space located between the outer wall of the inner pipe and the inner wall of the compression mold. After the inner pipe has been removed from the compression mold, the pressing of the powder mixture, the sintering, the cold forming of the compressed body, and finally the final processing of the penetrator blank, which are necessary for producing the penetrator, occur in a manner that is known per se.

By means of the method according to the invention, a penetrator is produced with a high-density core and ductile outer sheath connected to the penetrator core in a non-positive fashion, with the outer sheath preventing breakage in the case of oblique impact with the target. The production of a separate shell and time-consuming attachment of such a shell to the penetrator core, as is the case in DE 40 16 051 C2 cited above, may be omitted.

In an advantageous embodiment of the invention, a mixture with 95 wt.-% tungsten with the remainder of the mixture being composed of nickel and cobalt powder in a weight ratio of 9:1 has proven effective.

In a further embodiment of the invention, a second powder mixture containing tungsten with 87 wt.-% tungsten with the remainder of the mixture being composed of nickel and cobalt powder, also in a weight ratio of 9:1, has proven advantageous.

BRIEF DESCRIPTION OF THE DRAWINGS

The invention will be described in greater detail below with reference to an exemplary embodiment and the drawings, which show.

DETAILED DESCRIPTION OF THE INVENTION

Figure 1:
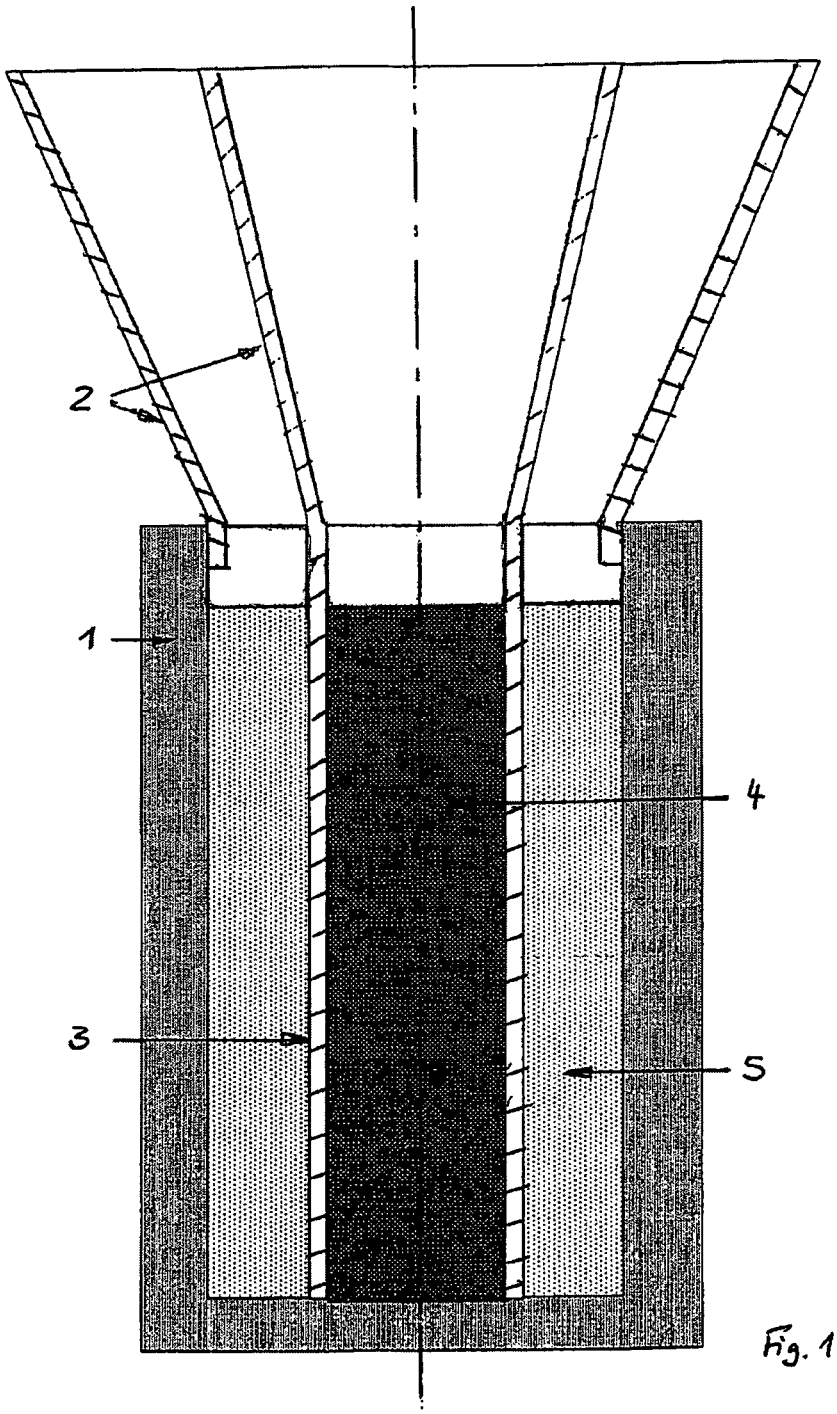
FIG. 1 a longitudinal section of a mold for producing a penetrator blank containing powder mixtures.

In FIG. 1, the reference number 1 is used to designate a compression mold made of plastic that has been adapted to the outer dimensions of the blank to be produced into which a double funnel filling device has been inserted in a concentric fashion. The inner pipe 3 and the double funnel 2 are preferably composed of stainless steel and have a wall thickness of approximately 1 mm. The annular space located between the compression mold 1 and the inner pipe 3 has a distance between its walls of approximately ⅛ of the inner diameter. The two concentric funnels are connected in the conical region with the aid of cross beams.

A first powder mixture 4 containing tungsten with a tungsten fraction of 95 wt.-%, the remainder being composed of nickel and cobalt powder in a 9:1 weight ratio, has been placed in the inner pipe 3. Subsequently, a second powder mixture 5 containing tungsten with a tungsten fraction of 87 wt.-%, with the remainder also being composed of nickel and cobalt powder in a 9:1 weight ratio, is placed in the annular space.

After the insertion of the powder mixtures 4 and 5, the double funnel filling device is removed from the compression matrix 1 and subsequently the entire powder mixture is hydrostatically compressed after a preliminary compacting, for example, by shaking. Subsequently, depending on the desired specifications of the completed penetrator, the blank is sintered, heat treated, cold formed, heat released, and subjected to final processing by metal cutting, all in a manner that is known per se, for example, from U.S. Pat. No. 3,979,234.

Figure 2:
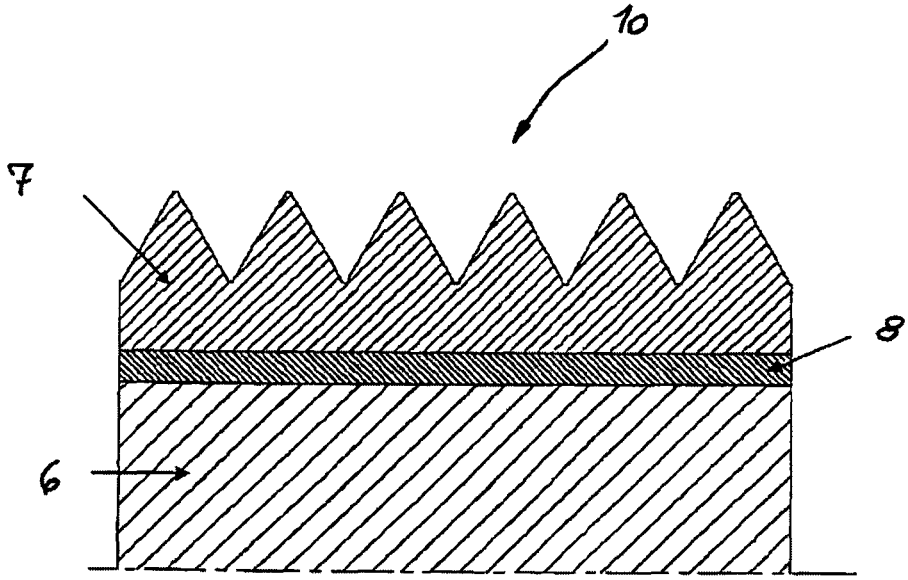
FIG. 2 a longitudinal section of a part of the penetrator produced using the method according to the invention.

FIG. 2 shows the longitudinal section of a part of the penetrator 10 produced using the method according to the invention. Here, the number 6 is used to designate the penetrator core, which is relatively brittle due to its high tungsten fraction, and the number 7 is used to designate the outer sheath with a thread, which is substantially more ductile due to its lower tungsten fraction.

A transitional area 8 results between the penetrator core 6 and the outer sheath 7 with a preferred thickness between 25 μm and 200 μm, which guarantees good adhesion between the core 6 and the sheath 7. The ductile sheath 7 is preferably removed in the pointed region by a chip removing process such that the point is composed of a core material and breaks in a brittle fashion upon impact with a target, resulting in ever sharper biting edges, which guarantee good biting behavior.

The invention claimed is:

1. A method for producing a penetrator made of a tungsten heavy metal core with a high tungsten fraction and having an outer sheath composed of a more ductile material compared to the penetrator core, comprising the steps of:

concentrically inserting an inner pipe adapted to dimensions of the penetrator core into a compression matrix adapted to exterior dimensions of the penetrator;

placing a double funnel filling device adapted to the dimensions of the penetrator core on the compression matrix;

filling the inner pipe only with a first powder mixture containing tungsten with a tungsten fraction between 90 wt.-% and 97 wt.-% using the double funnel filling device so that only the first powder mixture is in the inner pipe;

filling an annular space located between an outer wall of the inner pipe and an inner wall of the compression matrix using the double funnel filling device with a second powder mixture containing tungsten with a tungsten fraction between 85 wt.-% and 91 wt.-% that is less than the tungsten fraction of the first powder mixture;

subsequently removing the double funnel filling device and the inner pipe from the compression, matrix; and subjecting the entire powder mixture to preliminary compacting and hydrostatic compression so that the penetrator core is connected to the sheath by a transitional area having a thickness between 25 μm and 200 μm.

2. The method according to claim 1, wherein the first powder mixture containing tungsten contains 95 wt.-% tungsten and a remainder of the first powder mixture is composed of nickel and cobalt powder.

3. The method according to claim 2, wherein the nickel and cobalt powder in the first powder mixture has a weight ratio of nickel to cobalt between 2:1 and 10:1.

4. The method according to claim 3, wherein the nickel and cobalt powder in the first powder mixture has a weight ratio of 9:1.

5. The method according to claim 2, wherein the second powder mixture containing tungsten contains 87 wt.-% tungsten and a remainder of the second powder mixture is composed of nickel and cobalt powder.

6. The method according to claim 5, wherein the nickel and cobalt powder in the first powder mixture has a weight ratio of nickel to cobalt between 2:1 and 10:1.

7. The method according to claim 1, wherein the second powder mixture containing tungsten contains 87 wt.-% tungsten and a remainder of the second powder mixture is composed of nickel and cobalt powder.

8. The method according to claim 7, wherein the nickel and cobalt powder in the first powder mixture has a weight ratio of nickel to cobalt between 2:1 and 10:1.

9. The method according to claim 8, wherein the nickel and cobalt powder in the first powder mixture has a weight ratio of 9:1.

* * * * *